US011260684B2

(12) United States Patent
Faber

(10) Patent No.: US 11,260,684 B2
(45) Date of Patent: Mar. 1, 2022

(54) STAMP PAD UNIT

(71) Applicant: COLOP STEMPELERZEUGUNG SKOPEK GESELLSCHAFT M.B.H. & CO. KG., Wels (AT)

(72) Inventor: Ernst Faber, Wels (AT)

(73) Assignee: COLOP STEMPELERZEUGUNG SKOPEK GESELLSCHAFT M.B.H. & CO. KG., Wels (AT)

( * ) Notice: Subject to any disclaimer, the term of this patent is extended or adjusted under 35 U.S.C. 154(b) by 0 days.

(21) Appl. No.: 15/825,390

(22) Filed: Nov. 29, 2017

(65) Prior Publication Data

US 2018/0147869 A1 May 31, 2018

(30) Foreign Application Priority Data

Nov. 30, 2016 (AT) ..... A 51086/2016

(51) Int. Cl.
*B41K 1/40* (2006.01)
*B41K 1/54* (2006.01)

(52) U.S. Cl.
CPC . *B41K 1/54* (2013.01); *B41K 1/40* (2013.01)

(58) Field of Classification Search
CPC ... B41K 1/40; B41K 1/54; B41K 1/00; B41K 1/006; B41K 1/02; B41K 1/36; B41K 1/38; B41K 1/42; B41K 1/46; B41K 1/50; B41K 1/52; B41K 3/54; B41K 3/56
USPC ..... 101/327, 333, 334, 405, 406
See application file for complete search history.

(56) References Cited

U.S. PATENT DOCUMENTS 227,983 A * 5/1880 Leighton ..... B41K 1/54 101/333
2,290,488 A * 7/1942 Munson ..... B41K 1/54 118/264
3,215,073 A * 11/1965 Robinson ..... B41K 1/54 101/333
3,386,413 A 6/1968 Munson
4,031,853 A * 6/1977 Conrad ..... B41J 31/14 118/264

(Continued)

FOREIGN PATENT DOCUMENTS

AT 302 383 B 10/1972
AT 7 995 U1 12/2005

(Continued)

OTHER PUBLICATIONS

European Search Report in EP 17204546.0-1014, dated Mar. 29, 2018, with English translation of relevant parts.

(Continued)

*Primary Examiner* — Matthew G Marini
*Assistant Examiner* — Marissa Ferguson-Samreth
(74) *Attorney, Agent, or Firm* — Collard & Roe, P.C.

(57) ABSTRACT

There is disclosed a stamp pad unit (1), in particular for a self-inking stamp, which comprises two ink pads (2*a*, 2*b*) being arranged within a frame (3), abutting against opposing surfaces (4*a*, 4*b*) of a separating plate (5) and being separated thereby from each other, wherein the frame (3) consists of two separate frame parts (3*a*, 3*b*) which are connected with each other and within which the ink pads (2*a*, 2*b*) are accommodated, wherein at least one frame part (3*a*, 3*b*), preferably each of the frame parts (3*a*, 3*b*), comprises at least one inwardly directed retaining projection (6*a*, 6*b*) engaged with an ink pad (2*a*, 2*b*) for holding the ink pad (2*a*, 2*b*).

15 Claims, 5 Drawing Sheets

(56) References Cited

U.S. PATENT DOCUMENTS

| | | | | | |
|---|---|---|---|---|---|
| 5,586,500 | A * | 12/1996 | Takami | B41K 1/32 | 101/125 |
| 5,601,867 | A * | 2/1997 | Riedl | A61B 5/1172 | 118/31.5 |
| 6,640,709 | B1 * | 11/2003 | Lowrance | B41K 1/54 | 101/327 |
| 6,726,004 | B2 * | 4/2004 | Watson | A45C 11/04 | 206/45.23 |
| 7,124,684 | B1 | 10/2006 | Petersen | | |
| 7,246,556 | B1 * | 7/2007 | Stoneberg | B41K 1/54 | 101/333 |
| 8,567,459 | B2 * | 10/2013 | Kitchen | A45C 11/182 | 150/147 |
| 2002/0162842 | A1 * | 11/2002 | Pangerc | B25H 3/023 | 220/524 |
| 2016/0075067 | A1 | 3/2016 | Faber | | |

FOREIGN PATENT DOCUMENTS

| | | | |
|---|---|---|---|
| AT | 503 424 | A4 | 10/2007 |
| CH | 459 273 | A | 7/1968 |
| DE | 20 2004 018 103 | U1 | 1/2005 |
| DE | 10 2006 025534 | A1 | 12/2006 |
| FR | 797 863 | A | 5/1936 |
| JP | S58-53659 | U | 4/1983 |
| WO | 2014/172739 | A2 | 10/2014 |

OTHER PUBLICATIONS

Austrian Office Action in A 51086/2016, dated Sep. 18, 2017, with English translation of relevant parts.

* cited by examiner

STAMP PAD UNIT

CROSS REFERENCE TO RELATED APPLICATIONS

Applicant claims priority under 35 U.S.C. § 119 of Austrian Application No. A 51086/2016 filed on Nov. 30, 2016, the disclosure of which is incorporated by reference.

The invention relates to a stamp pad unit, in particular for a self-inking stamp, which comprises two ink pads being arranged within a frame, abutting against opposing surfaces of a separating plate and being separated thereby from each other.

Stamp pad units of the above-mentioned kind are known. The stamp pad units can be inserted into self-inking stamps in order to ink a printing plate of the self-inking stamp with a printing color, in particular ink, absorbed in the ink pads for a desired generation of a stamp imprint on a surface. When the printing ink (color) in one of the two ink pads is used up, the stamp pad unit can be turned around, and the stamping process can be continued with the still unconsumed other ink pad. Furthermore, in particular in case of self-inking stamps, after a longer dwelling time of the stamp pad unit received therein, the surface of the ink pad which abuts against the printing plate can be impaired by the printing plate itself. In particular, the stamp characters on the printing plate or the engraving on the printing plate can press themselves into the ink pad whereby the quality of the stamp imprint to be generated is reduced. By turning the stamp pad unit around, the stamping process can be continued very quickly by using the unconsumed ink pad. In contrast thereto, in case of a stamp pad unit with just one single ink pad, first of all said ink pad would have to be supplied once again with color or ink or would have to be replaced by a new ink pad which possibly has to be provided, acquired or purchased first of all, which might take a corresponding lot of time, before the stamping process can be continued.

In order to be able to reliably fix the ink pads within the frame of the stamp pad unit, they will be bonded by gluing with the frame and/or with the separating plate arranged between the ink pads. Here it is disadvantageous that the gluing can lead to unevennesses on that surface of the ink pad which is provided for abutting against a printing plate, even in still unused ink pads, whereby the quality of the stamp imprint to be generated is impaired.

AT 503 424 A4 discloses a stamp pad unit for a self-inking stamp, said stamp pad unit comprising a pad holder having a separating base and a circumferential edge. Within the circumferential edge, on both sides of the separating base there are arranged ink reservoirs (color reservoirs) for receiving stamp colors or inks. The stamp pad unit can be removed from the stamp and can be inserted therein once again in a turned-around state. From said citation there does, however, not follow any solution for the problem of the above-mentioned unevennesses due to a gluing of the ink pads with the pad holder.

In U.S. Pat. No. 3,386,413 there is shown an inking pad which can be turned around and which has a perforated plastic plate at the upper side and lower side of which there is arranged a partial pad, respectively. The perforations in the plastic plate enable a transfer of ink from the lower partial pad picking up ink from a reservoir to the upper partial pad. The partial, pads will be glued together with the plastic plate, whereupon the two partial pads will be covered with a fabric sheet, respectively. The fabric sheet will then be heat sealed with edges of the plastic plate. Thus, the ink pads produced in said manner also show the disadvantage of possible unevennesses.

DE 20 2004 018 103 U1 shows a retaining device with a retaining edge for holding only one single stamp pad.

U.S. Pat. No. 7,124,684 B1 refers to a one-piece stamp pad holder for one or two stamp pads which are separated from each other by a liquid-tight central barrier wall. The stamp pads are retained in the stamp pad holder by adhesives or by mechanical latching means which are not specified in detail.

US 2016/075067 A1 discloses a conventional ink pad holder having a bottom and walls projecting therefrom for the formation of a receiving space for one single ink pad.

JP S5853659 U refers to a different kind of stamp pad container and does not exhibit a two-part frame.

AT 302 383 B discloses a box made of an elastic material, with a single stamp pad inserted in a detachable manner, said stamp pad having a stiff base plate.

It is now an object of the invention to create a stamp pad unit as mentioned at the beginning which enables a stamp imprint of high quality. In particular in the unused state of the ink pads the stamp pad unit shall possibly not show any unevennesses in the ink pads, in particular not on the upper surfaces of both ink pads which face away from each other and which can be brought into contact with a printing plate. For an unimpaired inking of a printing plate, the ink pads accommodated in the stamp pad unit shall—at least in the still unused state—possibly have the same elastic properties, respectively, as prior to the reception in the stamp pad unit, i.e. they shall be free from sections hardened by adhesives.

For this purpose, the invention provides a stamp pad unit as described herein. Advantageous embodiments and further developments are also described herein.

Hence, in accordance with the invention it is provided that the frame consists of two separate (different) frame parts connected with each other, within which the ink pads are accommodated, wherein at least one frame part, preferably each of the frame parts, comprises at least one retaining projection for holding the ink pad, said retaining projection being directed inwardly and engaging an ink pad. Thus, the stamp pad unit which can be inserted into a self-inking stamp comprises a frame in which the separating plate and the two ink pads are arranged. The frame comprises side walls connected with each other, wherein those side walls which are adjacent to each other are arranged at right angles to one another, if the layout of the frame is formed according to a usual design in a rectangular or square form. As is normal for frames, the side walls extend between the opposing circumferential edges of the frame. Moreover, the height of the side walls or the height of the frame is determined in a known manner by the distance between the circumferential edges of the frame. Preferably, along its periphery, i.e. along its circumferential edges, the frame has a substantially constant height. The separating plate is provided as a separating base within the frame and is arranged at a distance from the circumferential edges of the frame. Between the side walls of the frame and on opposing surfaces of the separating plate there are arranged the ink pads which, thus, are separated from each other by means of the separating plate. In order to be able to reliably accommodate the ink pads without any adhesive bond with the frame within the frame, i.e. without the ink pads getting detached from the frame unintentionally, at least one retaining projection is provided at the frame against which retaining projection at least one ink pad will come to abut in such a manner that it cannot fall out of the frame. Advantageously, for each ink pad there is provided at least one retaining projection. Furthermore it is favourable when the retaining projection extends from the respective circumferential edge of the frame or at least as near as possible to the circumferential edge of the frame. In this connection, at least one retaining projection, preferably each retaining projection, can extend substantially at right angles from the respective side wall and inwardly, i.e. in the direction of one of the other side walls, in particular in the direction of the opposite side wall. In order to be able to bring the ink pads into the frame, the frame consists of two separate (different) frame parts, wherein each frame part is provided for the reception of one ink pad. For this, the ink pad will be inserted or slid into the respective frame part and in doing so will get into contact with the retaining projection. In particular, at least one frame part, preferably each of the frame parts, comprises at least one such inwardly directed retaining projection for holding an ink pad, said retaining projection being engaged with the ink pad in the operating position. The ink pad will be inserted or slid thereinto through an aperture of the frame part which is free from retaining projections. The frame parts are formed such that they can be connected with each other, and they will be connected with one another for instance by gluing or screwing together after the ink pads will have been inserted on opposing sides or surfaces of the separating plate into the frame parts. In this manner, the ink pads are separated from each other, they are without adhesive, and they are reliably accommodated within the frame; and hardened sections in the ink pads which otherwise can be caused by adhesives penetrating into the ink pads can be avoided. As the ink pads are secured by at least one retaining projection in the position of use within the frame and not by an adhesive bond, the quality of the stamp imprint will not be impaired by the reception of the ink pads within the frame.

In accordance with a preferred embodiment of the invention it is provided that the two ink pads and the separating plate together, i.e. one stacked on top of the other, have a thickness which corresponds to that of a standard ink pad. If the upper surfaces facing away from each other of the two ink pads inserted in their position of use within the frame do not lie within one plane with the circumferential edges of the frame, it is favourable when the height of the side walls or the height of the frame corresponds to the thickness or the height of a standard ink pad. Thereby it is guaranteed that the stamp pad unit which has the same thickness or height as a standard ink pad can be inserted into a stamp, for instance into a self-inking stamp, which is dimensioned for standard ink pads. As, in contrast to a standard ink pad, the stamp pad unit which has the same thickness comprises two ink pads, each of the two ink pads is correspondingly formed thinner than the standard ink pad. Accordingly, adhesive bonds known from prior art or adhesives penetrating into the ink pads and then hardening would have an even more negative influence on the quality of the stamp imprint. By the provision of the retaining projections instead of adhesive bonds, said disadvantage is avoided.

In order to be able to insert the ink pads as easily as possible into the frame parts, it is advantageous that the sum of the heights of both frame parts is substantially equal to the height of the frame. In this case, the frame is divided into two frame parts along its height extension or thickness extension, i.e. each frame part comprises one of the circumferential edges of the frame. In this connection it is favourable, but not absolutely necessary, when the virtual separating plane which divides the frame into the two frame parts extends in parallel to said plane in which a circumferential edge of the frame lies. Thus, the ink pads can be inserted from that open side or through that aperture of the frame part into said frame part which lies opposite the at least one retaining projection.

In an alternative embodiment, each frame part can comprise substantially the same height as the frame. In this case, the frame is divided into the two frame parts along its longitudinal extension or width extension, i.e. each frame part comprises a portion of both circumferential edges of the frame. Thus, the virtual separating plane which divides the frame into the two frame parts extends accordingly in an oblique manner or perpendicular to that plane in which a circumferential edge of the frame lies. In this connection, the ink pads can be inserted from that open side or through said aperture of each frame part thereinto which is created by the now not present side wall of the frame part.

In order to be able to retain the ink pads within the frame in a particularly reliable manner, it is favourable when the retaining projection is formed as a retaining edge which extends at least along a portion of the periphery of the frame part, preferably along the entire periphery of the frame part. A particularly large extension of the retaining edge favors a reliable retention of the ink pads within the frame. When the frame is divided into the two frame parts along its height extension or thickness extension, the retaining edge can extend as a circumferential retaining edge along the entire periphery of the frame part, i.e. along one of the circumferential edges of the frame. If, however, the frame is divided into the two frame parts along its longitudinal extension or width extension, each frame part preferably comprises two retaining edges lying opposite to each other, of which each retaining edge can only extend along a portion of one of the circumferential edges of the frame, respectively.

In order to be able to insert the ink pads as easily as possible into the frame parts, it is useful when the separating plate is formed separately from the frame parts. In this connection, first of all each ink pad can be inserted into one frame part, respectively, whereupon the separating plate will be inserted in between the ink pads, before the frame parts will be connected with each other. In contrast thereto, a separating plate produced in one piece together with a frame part could aggravate the insertion of the ink pads into said frame part. Preferably, the longitudinal extension and the width extension of the separating plate correspond to the respective internal dimensions of the frame so that the edge of the separating plate abuts as completely as possible against the internal surfaces of the side walls of the frame.

When the separating plate is formed such that it is impermeable to liquid (in a liquid-tight manner), an undesired transfer of printing color, in particular ink, from one ink pad which is still unused to another ink pad the printing color of which is nearly used up can be prevented. Thus, the complete consumption of the printing ink in the used ink pad can be recognized by the user of the stamp pad unit, and the use of the stamp pad unit can be continued in the turned-around state without having to once again ink the used-up ink pad in the meantime. Alternatively or supplementary to a subsequent new inking, during the use of the stamp pad unit in the turned-around state a new ink pad can be provided, acquired or purchased. In this connection, the separating plate is formed such that it is impermeable to printing ink, i.e. that it is liquid-tight, for those pressures which act upon the separating plate during the proper use of the stamp pad unit.

For a particularly robust and solid construction of the separating plate it can be provided that the separating plate consists of metal, for instance of steel. The separating plate thus formed in a robust and solid manner can prevent that the pressure which is exerted by a printing plate onto the currently used ink pad will be transferred in an undesired manner onto the other, still unused ink pad. When the separating plate is fixedly connected with the frame, for instance when it is formed in one piece with a frame part, the unused ink pad can be protected substantially against the entire pressure applied by the printing plate. When, however, the separating plate is formed separately from the frame and is inserted thereinto, it can at least be prevented that the characters or the engraving of the printing plate press themselves into the still unused ink pad.

Alternatively to a production of the separating plate out of metal, it can be provided that the separating plate consists of a rigid plastic material, for instance polyoxymethylene. Also in this manner the separating plate can be formed robustly and solidly in order to protect the still unused ink pad against damages or impairments caused by the pressure of a printing plate. Polyoxymethylene has a high strength, hardness and rigidity and, therefore, is particularly suitable as a material for the separating plate.

When both ink pads have the same thickness, advantageously the same number of stamping processes can be performed with both ink pads before the ink pads have to be replaced or have to be refilled with printing ink. Favourably, both ink pads are formed identically. In this case, the separating plate is arranged within the frame in the middle of the height extension of the frame.

Alternatively to ink pads having the same thickness it can be provided that one of the ink pads as a main pad has a larger thickness than the other ink pad forming a spare ink pad. Thus, by means of the main pad a larger number of stamping processes can be performed than when the ink pads are formed to have the same thickness, while after the turning of the stamp pad unit around and the continuation of the stamping process with the spare pad there still remains time to provide, acquire or purchase a new main pad. In this case, the separating plate is arranged within the frame offset the middle of the height extension of the frame.

In order to simplify the manufacturing process of the frame of the stamp pad unit, it can be useful that the two frame parts are formed to have the same size. In this case, the frame parts have an identical longitudinal extension, an identical width extension and an identical height extension.

Preferably, the two frame parts can be connected with each other mechanically and/or in a releasable manner. The mechanical connection can be a force-locking (non-positive) connection or preferably a form-locking (positive) connection. In this case, the two frame parts can be separated from each other without any damage in order to replace one or both ink pads. Subsequently, the two frame parts can once again be connected with each other for further use before the stamp pad unit is inserted into a stamp.

It is particularly advantageous when the two frame parts comprise interlocking latching elements, preferably releasably interlocking latching elements, for their mutual connection. In this manner, the frame parts can be connected with each other in a simple, quick and reliable manner. For instance, at least one hook elastically attached at one frame part can engage behind at least one projection arranged at the other frame part. When the latching elements interlock with each other in a releasable manner, the frame parts can once again be separated from each other for the replacement of the ink pads. In case of a non-separable latching connection or snap-in connection, after the using-up of the two ink pads the entire stamp pad unit has to be exchanged.

In accordance with a further embodiment of the invention it can be provided that the two ink pads are impregnated with different colors. Accordingly, by the turning of the stamp pad unit, stamp imprints of different colors can be generated. In this connection it is particularly favourable when the separating plate is formed and arranged in order to separate the two ink pads in a fluid-tight manner so that the penetration of printing ink of one ink pad into the other ink pad can be prevented. For this purpose, the separating plate can be made of a material being impermeable to printing ink and with longitudinal and width dimensions which guarantee a liquid-tight abutment of the separating plate against the internal surfaces of the side walls of the frame. Alternatively, a sealing element can be arranged along the circumferential edge of the separating plate.

In the following, the invention will be explained in further detail by means of preferred and non-limiting embodiments under reference to the drawing, wherein.

Figure 1A:
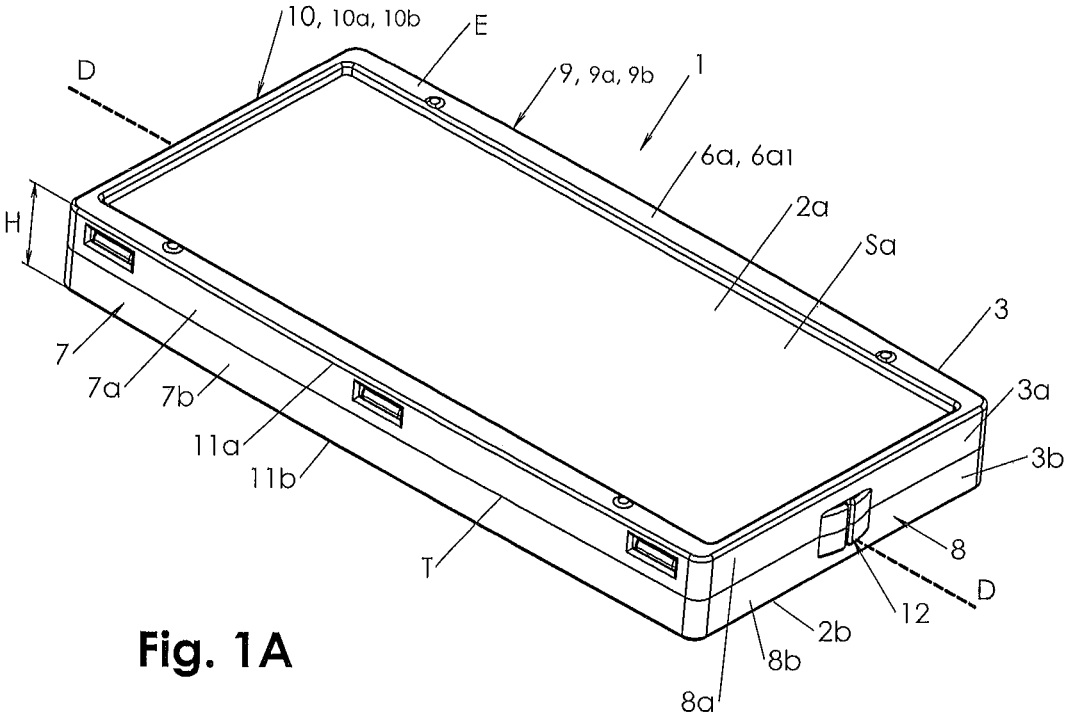
FIG. 1A shows a stamp pad unit according to the invention in a diagrammatic view with ink pads accommodated therein.

FIG. 1A shows an inventive stamp pad unit 1 which comprises two ink pads 2*a*, 2*b*, wherein in FIG. 1A only the ink pad 2*a* can be seen. The ink pads 2*a*, 2*b* are arranged within a frame 3 of the stamp pad unit 1 and rest against opposing surfaces 4*a*, 4*b* of a separating plate 5 (see inter alia FIGS. 2A, 2B, 3B, 3C, 4, and 5) of the stamp pad unit 1, said separating plate 5 separating the ink pads 2*a*, 2*b* from one another. In order to protect the ink pads 2*a*, 2*b* against a dropping out of the frame 3 and in order to be able to put them in a simple manner into the frame 3, the frame 3 consists of two separate (different, individually produced) frame parts 3*a*, 3*b* which are connected with each other and within which the ink pads 2*a*, 2*b* are accommodated. The fact that the frame 3 is composed of two frame parts 3*a*, 3*b* is indicated in FIG. 1A by a separating line T. For the holding of the ink pads 2*a*, 2*b*, the one frame part 3*a* has at least one retaining projection 6*a* which is directed inwardly and is engaged with the ink pad 2*a*, and the other frame part 3*b* also has at least one retaining projection 6*b* which is directed inwardly and is engaged with the ink pad 2*b*. In the embodiment according to FIG. 1A, the ink pad 2*a* is inserted or slid into through the aperture of the frame part 3*a* lying opposite the retaining projection 6*a*, and the ink pad 2*b* is inserted or slid into through the aperture of the frame part 3*b* lying opposite the retaining projection 6*b*. After insertion of the ink pads 2*a*, 2*b* into the frame parts 3*a*, 3*b*, the frame parts 3*a*, 3*b* will be connected with each other for instance by means of interlocking latching elements 12.

The frame 3 comprises side walls 7, 8, 9, 10 connected with each other which, jointly, substantially take the form of a rectangle. In this connection, the frame part 3*a* has sub-side walls 7*a* . . . 10*a* and the frame part 3*b* has sub-side walls 7*b* . . . 10*b*. The side walls 7 . . . 10 extend between the opposing circumferential edges 11*a*, 11*b* of the frame 3, wherein the height H of the side walls 7 . . . 10 or the height H of the frame 3 is determined by the distance between the circumferential edges 11*a*, 11*b* of the frame 3. The height H of the frame 3 is at the same time the thickness H of the frame 3. The height H of the frame 3 or the height (thickness) of the stamp pad unit 1 lies for instance between 7.2 and 7.4 mm, preferably at 7.3 mm, so that the stamp pad unit 1 has substantially the same thickness or height as a standard ink pad, and so that the stamp pad unit 1 can be smoothly inserted into a stamp which is dimensioned for a standard ink pad, for instance into a reception slot with a height of 7.6 mm of a self-inking stamp. As becomes in particular apparent from FIG. 2A, the sum of the heights Ha, Hb of the two frame parts 3*a*, 3*b* is equal to the height H of the frame 3. Along its periphery U, i.e. along its circumferential edges 11*a*, 11*b* which are substantially rectangular in shape, the frame 3 has a substantially constant height or thickness H. It goes without saying that in other embodiments the side walls 7 . . . 10 can have a form which is different from the rectangular form.

Figure 1B:
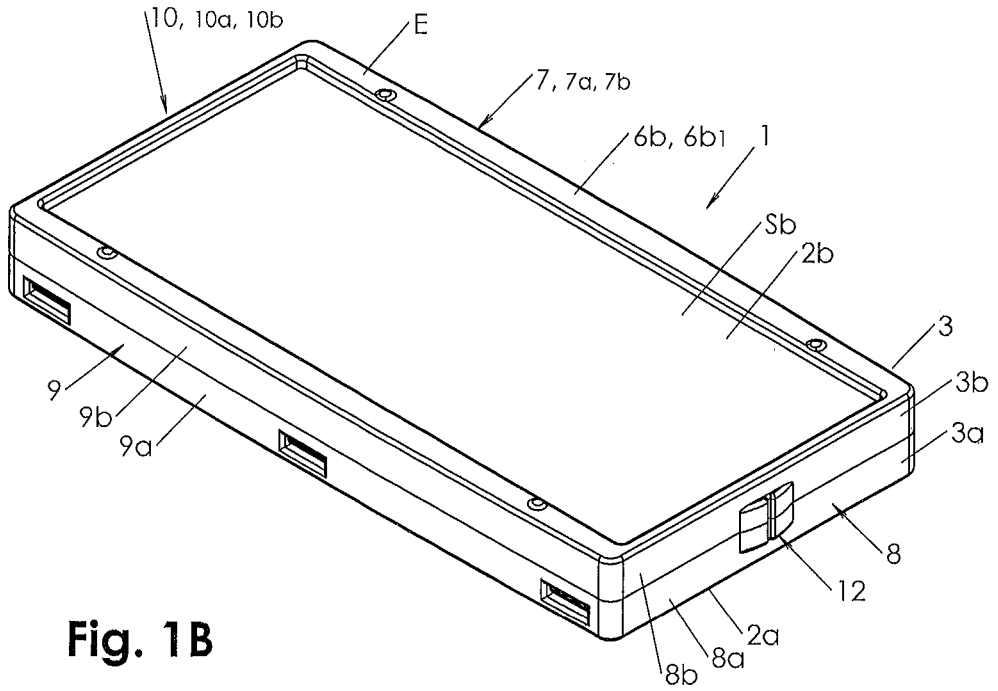
FIG. 1B shows the stamp pad unit of FIG. 1A in a diagrammatic view in a turned-around state.

FIG. 1B shows the stamp pad unit 1 of FIG. 1A in a turned-around state in which the stamp pad unit 1 was turned around an axis D (see FIG. 1A) by 180°.

Figure 2A:
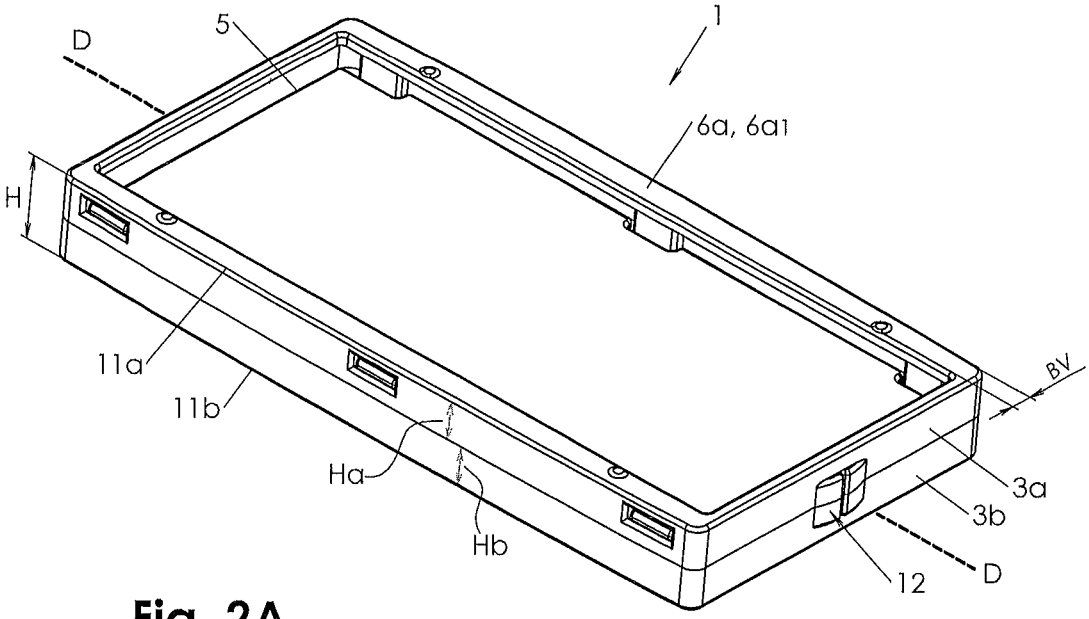
FIG. 2A shows the stamp pad unit of FIG. 1A in a diagrammatic view in which the ink pads are omitted.
Figure 2B:
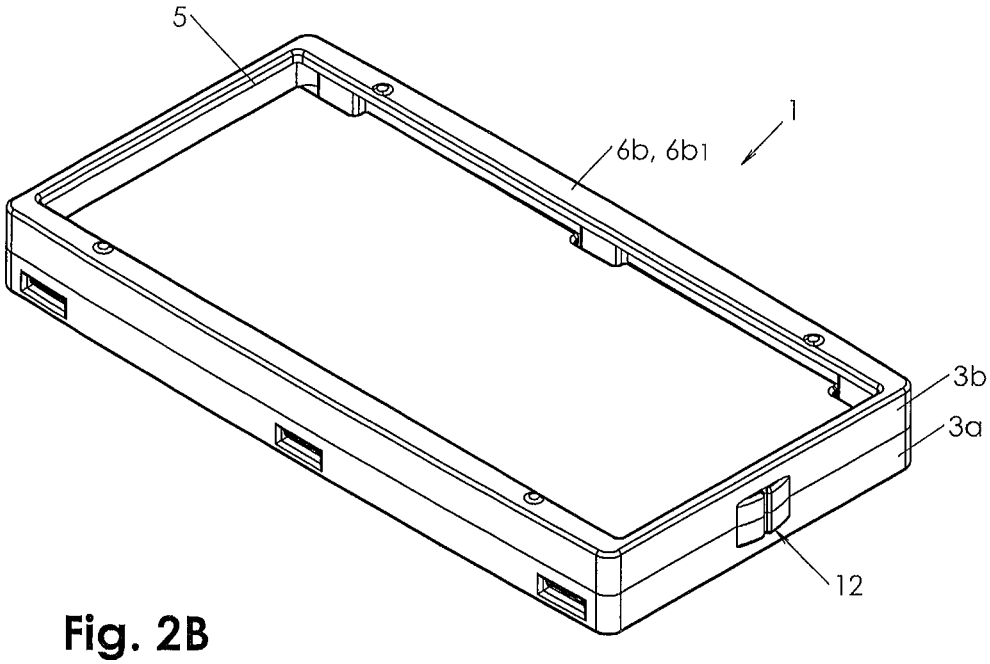
FIG. 2B shows the stamp pad unit of FIG. 2A in a diagrammatic view, with the ink pads being omitted and in a turned-around state.

FIG. 2A shows the stamp pad unit 1 of FIG. 1A in a diagrammatic view in which the ink pads 2*a*, 2*b* were omitted in order to be able to represent the separating plate 5. The separating plate 5 is provided as a separating base within the frame 3 and is arranged at a distance from the circumferential edges 11*a*, 11*b* of the frame 3 or from the retaining projections 6*a*, 6*b*. The ink pads 2*a*, 2*b* which are not represented in FIG. 2A and FIG. 2B are arranged between the side walls 7 . . . 10 of the frame 3 and on surfaces 4*a*, 4*b* (see FIG. 3A) of the separating plate 5 which are opposed to each other.

For instance in FIG. 1A and FIG. 1B, the retaining projections 6*a*, 6*b* extend inwardly from the respective circumferential edge 11*a*, 11*b* of the frame 3. The retaining projections 6*a*, 6*b* could also extend from a point as near as possible to the circumferential edge 11*a*, 11*b* of the frame 3. Preferably, the retaining projections 6*a*, 6*b* substantially extent at right angles from the respective side wall 7 . . . 10 inwardly with a possibly varying width BV so that each retaining projection 6*a*, 6*b* points into the direction of the side wall 7 . . . 10 lying opposite thereto. Preferably, the retaining projections 6*a*, 6*b* lie within the plane of the circumferential edges 11*a*, 11*b*.

Figure 6:
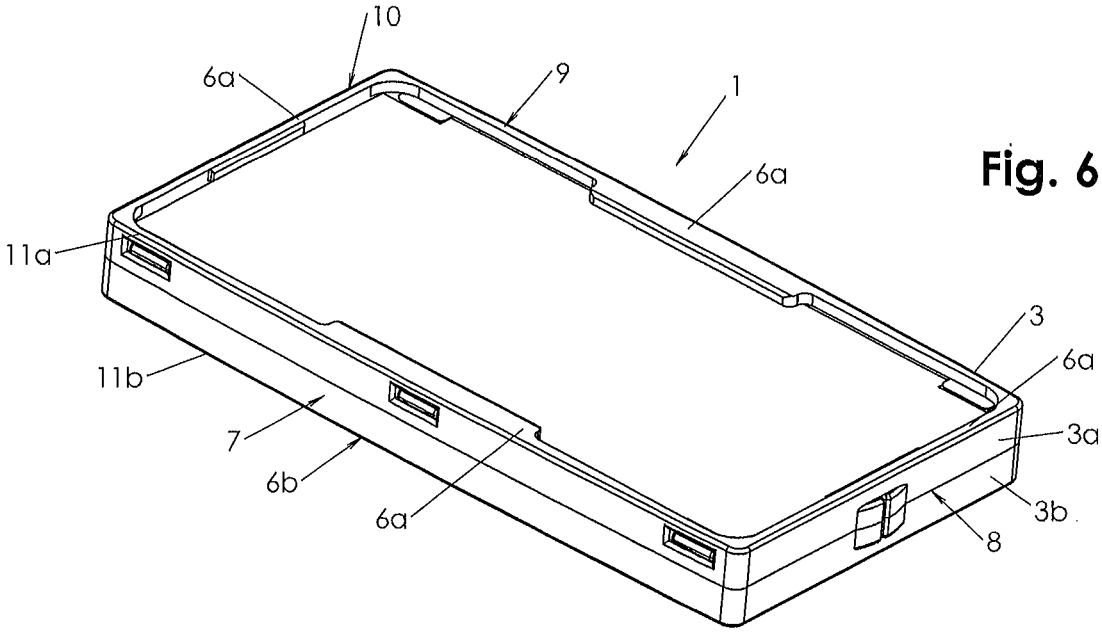
FIG. 6 shows a stamp pad unit according to the invention with bracket-, tongue- or lug-shaped retaining projections.

Even if in FIG. 1A and FIG. 1B the retaining projections 6*a*, 6*b* are for instance formed as retaining edges 6*a*1, 6*b*1 which extend along the entire periphery U of the respective frame part 3*a*, 3*b*, according to a simplified representation in FIG. 6 of the stamp pad unit 1, it could be provided that the retaining projections 6*a*, 6*b* only extend along a portion of the periphery U of the respective frame part 3*a*, 3*b*. In this case, at least one retaining projection 6*a*, 6*b* is formed such that it is shorter that one of the side walls 7 . . . 10. In particular there can be provided more than one retaining projection 6*a*, 6*b* per side wall 7 . . . 10. When the retaining projections 6*a*, 6*b* only extend along a portion of the periphery U of the respective frame part 3*a*, 3*b*, said retaining projections 6*a*, 6*b* can be formed in the shape of brackets, tongues or lugs (see FIG. 6) or pins.

The retaining projections 6*a*, 6*b* or the retaining edges 6*a*1, 6*b*1 can have a width BV of several millimeters, for instance in the range of 1 mm up to 5 mm, preferably in the range of 2 mm up to 4 mm, wherein said width BV can vary along the periphery U of the frame parts 3*a*, 3*b*.

FIG. 2B shows the stamp pad unit 1 of FIG. 2A in a turned-around state in which the stamp pad unit 1 was rotated around an axis D (see FIG. 2A) by 180°. Here it is also apparent that the separating plate 5 is arranged in the middle of the height extension H of the frame. In FIG. 2A and FIG. 2B for instance, the two ink pads 2*a*, 2*b* have the same thickness, and the two frame parts 3*a*, 3*b* are formed such that they have the same size. Furthermore, at the frame 3 or at the frame parts 3*a*, 3*b* there are provided interlocking latching elements 12 by means of which the frame parts 3*a*, 3*b* can be connected with each other by latching, preferably in a releasable manner.

Figure 3:
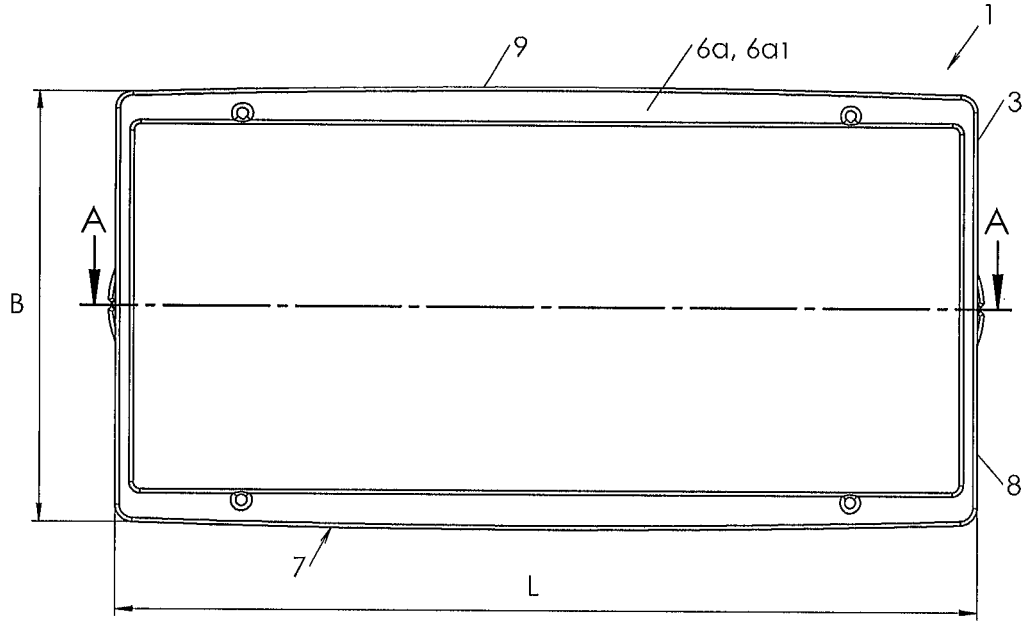
FIG. 3 shows the stamp pad unit of FIG. 1A in a view from the top.

FIG. 3 shows the stamp pad unit 1 of FIG. 1A in a view from the top. The frame 3 or the stamp pad unit 1 has a longitudinal extension L and a width extension B.

Figure 3A:
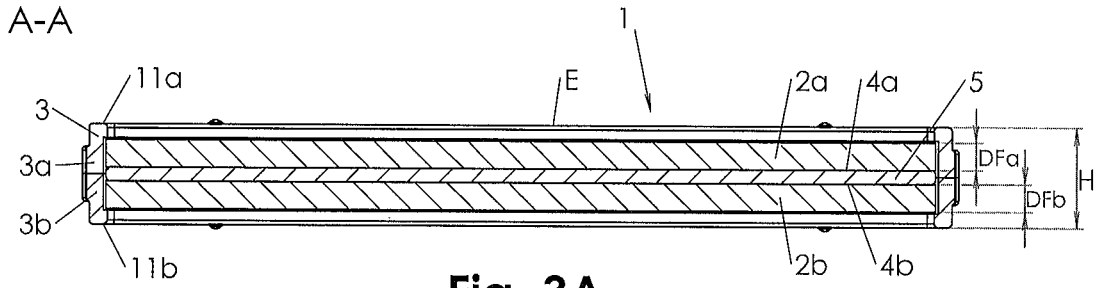
FIG. 3A shows the stamp pad unit of FIG. 3 in a sectional view along line A-A in FIG. 3.

FIG. 3A shows the stamp pad unit 1 of FIG. 3 in a sectional view along line A-A as represented in FIG. 3. The frame 3 consisting of the two separate frame parts 3*a*, 3*b* which are connected with each other, the separating plate 5 and the ink pads 2*a*, 2*b* can be clearly recognized. The separating plate 5 is arranged in the middle of the height extension H of the frame 3 so that the ink pads 2*a*, 2*b* are formed such that they have the same thickness or the same height. In this connection, the ink pad 2*a* has a thickness DFa and the ink pad 2*b* has a thickness DFb. Together, both ink pads 2*a*, 2*b* and the separating plate 5 can have a thickness H corresponding to a standard ink pad. If the upper surfaces Sa, Sb (FIGS. 1A, 1B, and 7) facing away from each other of the two ink pads 2*a*, 2*b* inserted into the frame 3 in their position of use do not lie within a plane E (FIGS. 1A, 1B, and 3B) with the circumferential edges 11*a*, 11*b* of the frame 3, it is advantageous when the height H of the side walls 7 . . . 10 or the height H of the frame 3 corresponds to the thickness or height of a standard ink pad.

Figure 3B:
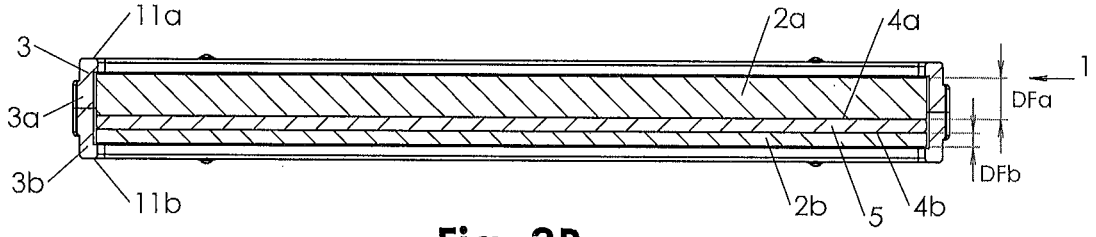
FIG. 3B shows a sectional view similar to FIG. 3A of a stamp pad unit in which the ink pads are formed with different thicknesses.

In contrast to FIG. 3A, FIG. 3B shows a stamp pad unit 1 in a sectional view in which the separating plate 5 is arranged outside of (offset) the middle of the height extension H of the frame 3 so that the inkpads 2*a*, 2*b* are formed such that they have different thicknesses or different heights. In particular, the ink pad 2*a* as the main pad has a larger thickness DFa than the ink pad 2*b* forming a spare pad with the thickness DFb.

Figure 4:
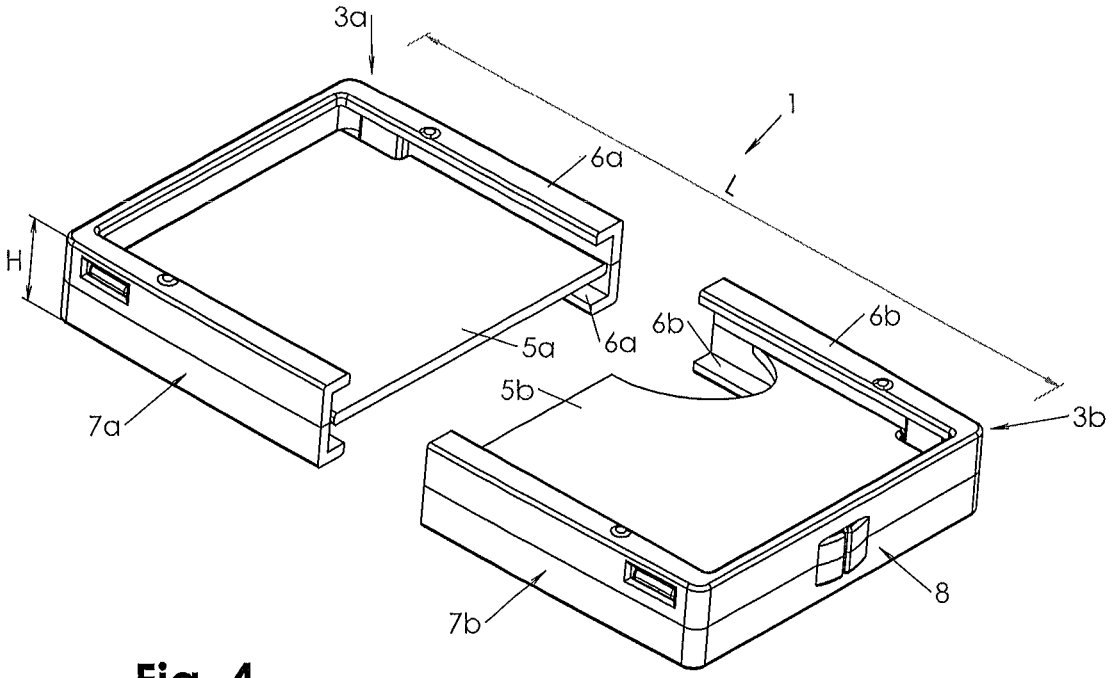
FIG. 4 shows a stamp pad unit according to the invention in a diagrammatic view in which the ink pads are omitted, with frame parts being separated from each other, wherein the frame is divided into the two frame parts along its longitudinal extension.

FIG. 4 shows a stamp pad unit 1 in which the ink pads 2*a*, 2*b* are omitted, with frame parts 3*a*, 3*b* being separated from each other. In contrast to the representations in FIG. 1A to FIG. 3C in which the frame 3 is divided into the two frame parts 3*a* and 3*b* in the direction of its height extension or thickness H, in FIG. 4 the frame 3 is divided into the two frame parts 3*a*, 3*b* in the direction of its longitudinal extension L. As becomes obvious from FIG. 4, the separating plate 5 can be divided into two partial plates 5*a*, 5*b*, or, as for instance shown in FIG. 2A and FIG. 2B, it can be formed in one piece. In FIG. 4, the partial plate 5*b* is represented in a partially cut-out manner only in order to be able to recognize a part of the components of the stamp pad unit 1 which lie underneath thereof. Independent of the fact in which direction the frame 3 is divided into the frame parts 3*a*, 3*b*, the one-piece or multi-piece separating plate 5 can be formed separately from the frame parts 3*a*, 3*b*. In the embodiment according to FIG. 4, alternatively the separating plate 5 can be formed in one piece with one of the frame parts 3*a*, 3*b*.

Figure 5:
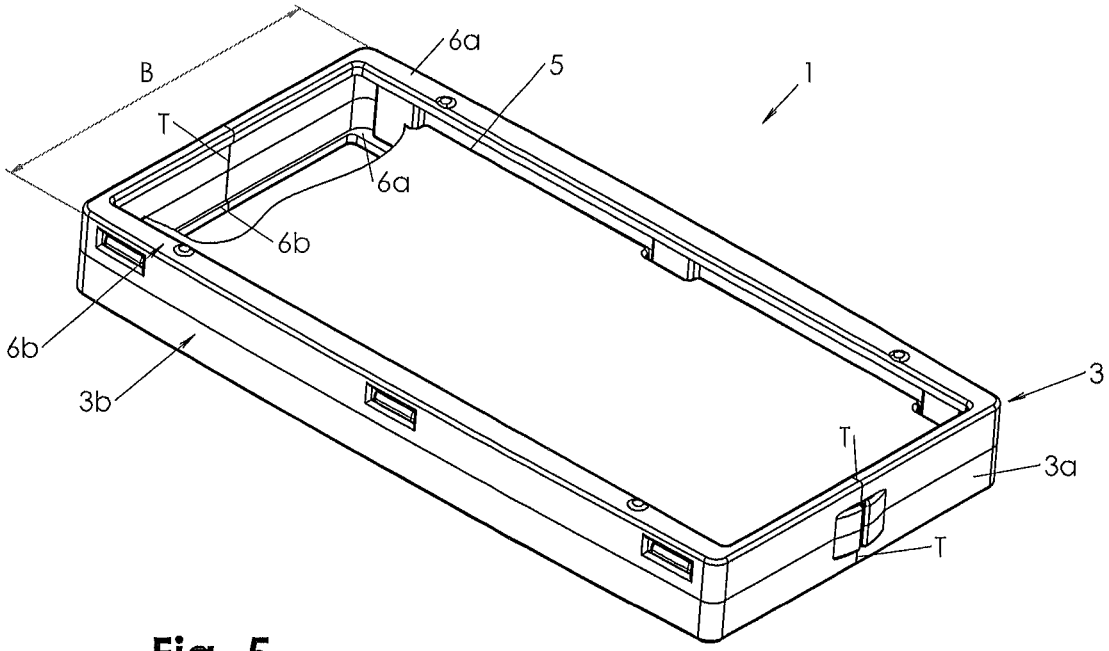
FIG. 5 shows a stamp pad unit according to the invention in a diagrammatic view in which the ink pads are omitted, wherein the frame is divided into the two frame parts along its width extension.

FIG. 5 shows a further stamp pad unit 1, with the ink pads 2*a*, 2*b* being omitted, wherein the frame parts 3*a*, 3*b* have already been connected with each other. In said embodiment, the frame 3 is divided into the two frame parts 3*a*, 3*b* in the direction of its width extension B, which is indicated by the separating line T. In this example, the separating plate 5 is formed in one piece, and only in order to be able to recognize a part of the components of the stamp pad unit 1 which lie underneath thereof, it is represented in a partially cut-out manner.

Figure 7:
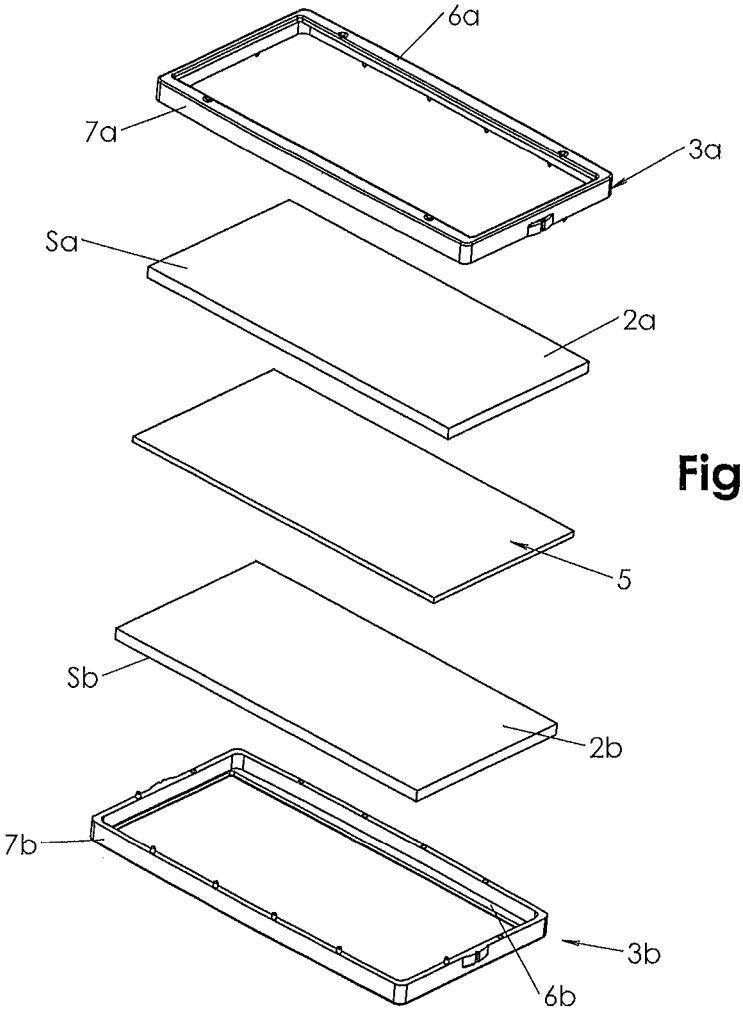
FIG. 7 shows a stamp pad unit according to the invention in an exploded view.

FIG. 7 shows a stamp pad unit 1 according to FIG. 1A in an exploded view. In order to assemble the stamp pad unit 1, for instance an ink pad 2*b* is inserted into the frame part 3*b* such that the ink pad 2*b* abuts against the retaining projection 6*b*. Then the separating plate 5 is put onto the ink pad 2*b*, and the other ink pad 2*a* is put onto the separating plate 5. Subsequently, the frame part 3*a* is clapped on the ink pad 2*a* such that the ink pad 2*a* abuts against the retaining projection 6*a*, and it will be connected with the frame part 3*b*, for instance by means of a latching connection which is not represented in FIG. 7. In this connection, the latching connection can be formed in a known manner with a hook and a groove or an undercut.

What is claimed is:

1. A stamp pad unit comprising:

two ink pads;

a separating plate; and a frame with two opposite open sides and with a circumferential, self-contained side wall extending between the two open sides, which side wall comprises two opposite circumferential edges, each of the edges delimiting one of the two open sides;

wherein the separating plate is arranged between the two ink pads and separates the ink pads from each other;

wherein the separating plate and the two ink pads are accommodated releasably within the frame such that the frame surrounds the two ink pads and the separating plate circumferentially and each ink pad is exposed through one of the two open sides of the frame;

wherein the two ink pads are held together and against the separating plate by at least two retaining projections of the frame;

wherein on each of the two open sides of the frame at least one of the at least two retaining projections extends inwardly;

wherein the frame is composed of two separate frame parts which are connected with each other; and wherein on each of the two separate frame parts at least one of the at least two retaining projections is formed in one piece.

2. The stamp pad unit according to claim 1, wherein the two ink pads and the separating plate together have a thickness which corresponds to that of a standard ink pad.

3. The stamp pad unit according to claim 1, wherein the sum of the heights of the two frame parts is substantially equal to the height of the frame.

4. The stamp pad unit according to claim 1, wherein the retaining projection is formed as a retaining edge which extends at least along a portion of the periphery of the frame part.

5. The stamp pad unit according to claim 1, wherein the separating plate is formed in a liquid-tight manner.

6. The stamp pad unit according to claim 1, wherein the separating plate comprises metal.

7. The stamp pad unit according to claim 1, wherein the separating plate comprises a rigid plastic material.

8. The stamp pad unit according to claim 1, wherein the two ink pads have the same thickness.

9. The stamp pad unit according to claim 1, wherein one of the ink pads as a main pad has a larger thickness than the other ink pad forming a spare pad.

10. The stamp pad unit according to claim 1, wherein the two frame parts are formed such that they have the same size.

11. The stamp pad unit according to claim 1, wherein the two frame parts comprise interlocking latching elements for their mutual connection.

12. The stamp pad unit according to claim 1, wherein the two ink pads are impregnated with different colors.

13. A stamp pad unit comprising:

two ink pads;

a separating plate; and a frame with two opposite open sides and with a circumferential, self-contained side wall extending between the two open sides, which side wall comprises two opposite circumferential edges, each of the edges delimiting one of the two open sides;

wherein the separating plate is arranged between the two ink pads and separates the ink pads from each other;

wherein the separating plate and the two ink pads are accommodated releasably within the frame such that the frame surrounds the two ink pads and the separating plate circumferentially and each ink pad is exposed through one of the two open sides of the frame;

wherein the two ink pads are held together and against the separating plate by at least two retaining projections of the frame; and wherein on each of the two open sides of the frame at least one of the at least two retaining projections extends inwardly.

14. A method for assembling a stamp pad unit comprising the steps of:

providing a first frame part having at least one first retaining projection extending inwardly on an open side of the first frame part;

inserting a first ink pad into the first frame part from a side different to the open side comprising the at least one first retaining projection such that the first ink pad abuts against the at least one first retaining projection and is exposed through the open side of the first frame part;

arranging a separating plate onto the first ink pad;

arranging a second ink pad onto the separating plate;

arranging a second frame part on the second ink pad, the second frame part having at least one second retaining projection extending inwardly on an open side of the second frame part, such that the second ink pad abuts against the at least one second retaining projection and is exposed through the open side of the second frame part; and connecting the second frame part with the first frame part to together form a frame with two open sides.

15. The method according to claim 14, wherein connecting the second frame part with the first frame part comprises establishing a latching connection between the first frame part and the second frame part.

* * * * *